US008536528B2

(12) United States Patent
DiFoggio

(10) Patent No.: US 8,536,528 B2
(45) Date of Patent: Sep. 17, 2013

(54) SYSTEM AND METHOD FOR DOWNHOLE VOLTAGE GENERATION

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 877 days.

(21) Appl. No.: 12/635,060

(22) Filed: Dec. 10, 2009

(65) Prior Publication Data

US 2010/0147349 A1 Jun. 17, 2010

Related U.S. Application Data

(60) Provisional application No. 61/121,982, filed on Dec. 12, 2008.

(51) Int. Cl.
*G01J 5/00* (2006.01)

(52) U.S. Cl.
USPC ..... 250/338.3

(58) Field of Classification Search
USPC ..... 250/338.3
See application file for complete search history.

(56) References Cited

U.S. PATENT DOCUMENTS 3,571,592 A * 3/1971 Glass ..... 250/338.3
3,978,939 A * 9/1976 Trouiller ..... 181/104
4,214,165 A * 7/1980 Asawa ..... 250/338.3
5,949,072 A 9/1999 Takada et al.
6,408,649 B1 * 6/2002 Sklyarevich et al. ..... 65/102
6,425,287 B1 7/2002 Tominaga et al.
6,657,358 B2 * 12/2003 Perner ..... 310/300
7,423,258 B2 9/2008 DiFoggio et al.
2007/0029197 A1 2/2007 DiFoggio et al.

OTHER PUBLICATIONS

International Preliminary Report on Patentability and Written Opinion, Mailed Jun. 23, 2011, International Appln. No. PCT/US2009/067716, Written Opinion 3 Pages, International Preliminary Report 2 Pages.
Geuther, et al. "Applications of pyroelectric particle accelerators". Science Direct. Nuclear Instruments and Methods in Physics Research B 261 (2007) 110-113.
Geuther, et al. "Enhanced neutron production from pyroelectric fusion". Applied Physics Letters, 90, 174103 (2007).
Geuther, et al. "Development of a Pyrocelectric neutron Source". U.S. Department of Energy Nuclear Engineering Education research Highlights-III. pp. 491-492.
Geuther, et al. "Electron Acceleration for X-ray Production Using Paired Pyroelectric Crystals". pp. 591-595.
Geuther, et al. "Pyroelectric Electron Acceleration: Improvements and Future Applications". DOE NEER: Highlights of Recent and Current Research-I. pp. 885-886.
Geuther, et al. "Electron and positive ion acceleration with pyroelectric crystals". Journal of Applied Physics 97, 074109 (2005).

(Continued)

*Primary Examiner* — David Porta
*Assistant Examiner* — Edwin Gunberg
(74) *Attorney, Agent, or Firm* — Cantor Colburn LLP

(57) ABSTRACT

A system for supplying voltage to a downhole component is disclosed. The system includes: a pyroelectric material disposed in electrical communication with the component, the component configured to be disposed within a borehole in an earth formation; and a heating unit in operable communication with the pyroelectric material and configured to change a temperature of the pyroelectric material and cause the pyroelectric material to generate a voltage to activate the component. A method of supplying voltage to a downhole component is also disclosed.

20 Claims, 5 Drawing Sheets

(56) References Cited

OTHER PUBLICATIONS

Geuther, et al. "Nuclear Reactions Induced by a Pyroelectric Accelerator". Physical Review Letters. PRL 96, 054803 (2006).
Lang, Sidney B. "Pyroelectricity: From Ancient Curiosity to Modern Imaging Tool". Physics Today. Aug. 2005. pp. 31-36.
Laser Components. Pyroelectric Detectors in Theory and Practice. 9 pages.
Lithium Niobate/Lithium Tantalate, acoustic crystals. Crystal Technology, Inc. an EPCOS Company.
Pauley, et al. "Studies of a Pyroelectric Crystal to Develop a Tabletop Neutron Source". Indiana University. Dec. 15, 2007.
White, et al. "A novel thick-film piezoelectric micro-generator". Technical Note. Institute of Physics Publishing. Smart Mater. Struct. 10 (2001). 850-852.

* cited by examiner

SYSTEM AND METHOD FOR DOWNHOLE VOLTAGE GENERATION

CROSS REFERENCE TO RELATED APPLICATIONS

This application claims the benefit of an earlier filing date from U.S. Provisional Application Ser. No. 61/121,982 filed Dec. 12, 2008, the entire disclosure of which is incorporated herein by reference.

BACKGROUND OF THE INVENTION

Some downhole devices used in hydrocarbon exploration and production, such as acoustic transducers for imaging the formation through drilling mud or for measuring formation or fluid properties, require high voltage power sources for actuation. Such sources may be included at a surface location and electrically connected to the device. However, usually the high voltage generator is located downhole within a logging tool pressure housing, which means that it is still exposed to the high downhole temperatures. Common ways to generate a high DC voltage all involve the use of capacitors, which degrade with temperature. For example, a small DC voltage, "V", can be used to charge a number ("N") of capacitors in parallel. Then, the capacitors can be discharged in series to produce an N times larger voltage, NV. Alternatively, one can chop a low DC voltage rapidly enough that it can be put through a step-up transformer after which a large capacitor smoothes out the chopping ripple on the high voltage. At oil well temperatures (typically up to approximately 200 C), one can expect the capacitance to drop to half of its room temperature value (due to a drop in dielectric constant of the filling material) and the leakage current (the conductivity of the filling material) to rise considerably. For even hotter geothermal wells (up to 300 C), these effects are exacerbated. For geothermal wells, a high voltage generator could be placed inside of a thermal flask to temporarily shield it from the heat. However, placing the generator inside the thermal flask would limit the length of time that it could be operated.

BRIEF SUMMARY OF THE INVENTION

A system for supplying voltage to a downhole component includes: a pyroelectric material disposed in electrical communication with the component, the component configured to be disposed within a borehole in an earth formation; and a heating unit in operable communication with the pyroelectric material and configured to change a temperature of the pyroelectric material and cause the pyroelectric material to generate a voltage to activate the component.

A method of supplying voltage to a downhole component includes: disposing the component and a pyroelectric material in a borehole in an earth formation, the pyroelectric material disposed in electrical communication with the component; applying thermal energy to the pyroelectric material to cause the pyroelectric material to change temperature and emit a voltage; and conveying the voltage to the component to activate the component.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
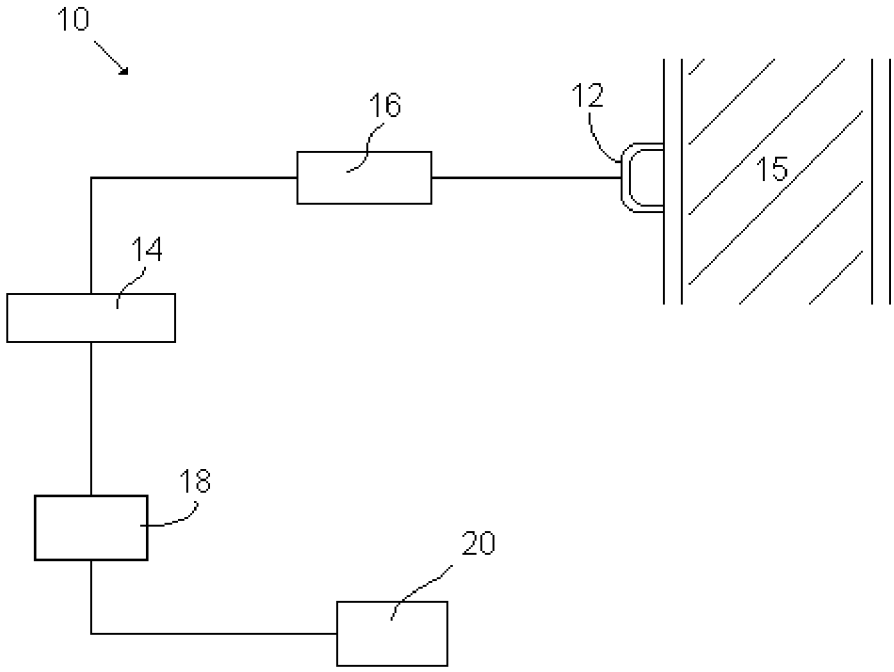
FIG. 1 depicts an exemplary embodiment of a transducer assembly including a pyroelectric voltage source.

Referring to FIG. 1, a transducer assembly 10 is shown, configured to be disposed in a downhole tool or otherwise disposed downhole in a borehole in an earth formation. The transducer assembly 10 includes at least one transducer 12 positioned to measure one or more properties of a borehole, borehole fluid and/or the earth formation. A pyroelectric voltage source 14 is electrically connected to the transducer 12 for transmitting a voltage pulse to activate the transducer 12.

In one embodiment, the transducer 12 is an acoustic transducer 12 configured to emit sound waves into a formation sample 15. In one embodiment, additional acoustic transducers are included to emit sound waves, and/or one or more additional acoustic transducers are included to receive sound waves reflected from the sample 15 or transmitted through the sample 15 and convert such waves to an electrical signal. Actuating the pyroelectric source 14 causes the pyroelectric source 14 to generate a voltage pulse to fire the acoustic transducer 12, i.e., actuate the acoustic transducer 12 and cause the acoustic transducer 12 to generate an acoustic pulse. Optionally, an output circuit 16 is included to control the voltage pulse.

The voltage source 14 includes a pyroelectric material capable of generating electricity in response to a change in temperature. A pyroelectric material generates a voltage by responding to a change in the temperature of the pyroelectric material and producing a voltage change across its opposite surfaces that is proportional to product of the pyroelectric coefficient with the change in pyroelectric material's temperature. In one embodiment, the pyroelectric voltage source 14 is a high voltage source capable of generating a voltage of approximately 360 Volts.

As long as it is below its Curie temperature, a pyroelectric crystal is spontaneously polarized so it exhibits bound charge of opposite polarity at opposite faces. When heated or cooled, it undergoes a change in its polarization, and in its corresponding bound surface charge. At atmospheric pressure, this surface charge is quickly masked by charges from the air. However, in a vacuum, a high voltage can build up across opposite faces of the crystal as the temperature of the crystal changes. In 1992, Brownridge (*Pyroelectric X-ray Generator, Nature,* 358, 28) reported that X-rays could be produced by heating or cooling a pyroelectric crystal in vacuum. Since then, pyroelectric X-ray generators up to 200 keV have been developed that use only a few watts of power.

Examples of such pyroelectric materials include lithium niobate (LiNbO3), lithium tantalate (LiTaO3), gallium nitride (GaN), caesium nitrate ($CsNO_3$), polyvinyl fluorides, derivatives of phenylpyrazine, cobalt phthalocyanine and triglycine sulfate (TGS). Lithium tantalate has a Curie temperature of 601 degrees C. and its pyroelectric coefficient (which is approximately 190 $\mu C/m^2K$) actually increases slightly with increasing temperature up to about 400 C. Accordingly, lithium tantalate is an exemplary pyroelectric material that is well suited for downhole environments, where temperatures can exceed 300 degrees C. Other materials with high pyroelectric coefficients and high Curie temperatures include lead titanate (PbTiO3, pyroelectric coefficient of 165 μC/m$^2$K, Curie temperature of 470 C) and lithium niobate (LiNbO3, pyroelectric coefficient of 104 μC/m$^2$K, Curie temperature of 1140 C). In one embodiment, for downhole applications, it is preferable to use a pyroelectric material whose Curie temperature is at least 150 degrees C. higher than ambient (for example, greater than 450 degrees C. for 300 degrees C. ambient) to provide ample headroom for heating the material in order to change its surface charge.

A heating unit 18 is included in operable communication with the voltage source 14 to apply heat to the pyroelectric material and cause a change in temperature sufficient to generate a desired voltage pulse. A control unit 20 is operably connected to the heating unit 18 to control the heating unit 18. The control unit 20 is positioned downhole as part of the transducer assembly 10 and/or a downhole tool, is positioned at a surface location or is positioned at any other location in the borehole.

In one embodiment, the heating unit 18 includes or is connected to a source of electric power, and includes a resistive conductor that is in contact with the pyroelectric material. Application of electric current to the resistive conductor causes the conductor to heat up and correspondingly causes the pyroelectric material to heat up.

In another embodiment, the heating unit 18 includes a source of electromagnetic radiation directed toward the pyroelectric material. Examples of the source of electromagnetic radiation include a flash lamp, laser, or other very bright light source directed toward the pyroelectric material to heat the material suddenly with a burst of energy.

Figure 2:
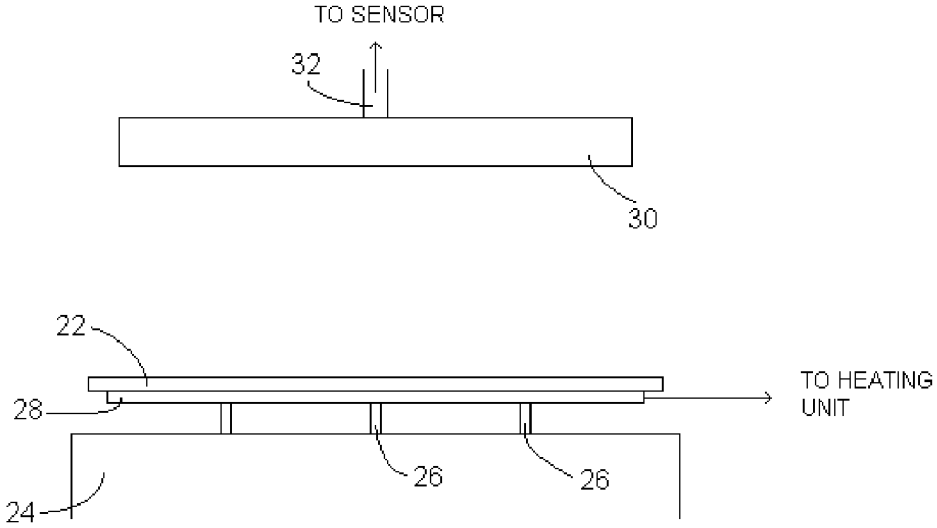
FIG. 2 depicts an exemplary embodiment of the pyroelectric voltage source of FIG. 1.

Referring to FIG. 2, an embodiment of the pyroelectric voltage source 14 is shown. A thin film 22 of pyroelectric material is mounted on a substrate 24. In one embodiment, the thin film 22 is mounted on a plurality of protrusions 26 or "stilts" extending from the substrate 24 to reduce the thin film's thermal contact with the substrate 24 and to allow it to change temperature more rapidly and thus achieve a higher voltage with a faster duty cycle. In one embodiment, a "thin film" refers to film that is between approximately 1 and 100 microns, where the latter is approximately the average diameter of a human hair (80 microns).

In one embodiment, a resistor 28 is disposed in contact with the thin pyroelectric film 22 to rapidly heat the thin pyroelectric film 22. In one embodiment, the resistor 28 is a thin film resistor to reduce thermal mass and facilitate rapid heating of the thin pyroelectric film 22.

Upon application of heat to the thin pyroelectric film 22, electrons are released, which flow away from the thin pyroelectric film 22 and toward a conductor to produce a current and a voltage therein. For example, a conductive plate 30 is positioned facing the thin pyroelectric film 22 and is further connected to a conductive wire 32 to deliver the current to the output circuit 16 and/or the transducer 12.

For example, for a thin film of lithium tantalate at room temperature, the maximum pyroelectric current and voltage response are 11 microamps per Watt and 19 Volts per Watt, respectively. Accordingly, a 19 Watt pulse of heating may be applied to the thin pyroelectric film 22 to produce a 361 Volt pulse containing 209 microamps of current, which is sufficient to fire the acoustic transducer 12, for example. In addition, as the pyroelectric coefficient increases slightly at higher temperatures that are still well below the Curie temperature, the 19 Watt pulse is sufficient to produce an even higher voltage pulse to fire the thin pyroelectric film 22.

In one embodiment, the pyroelectric material is similar to a pyroelectric infrared detector, which can operate in air because it is so thin (on the order of microns) that it has very low thermal mass so it can change temperature sufficiently (e.g., tens of micro Kelvin) to produce a signal when intermittently heated by an alternating source such as a flickering (e.g., 10-60 Hz) light source. The flickering light causes changes of alternating sign in its surface charge (as it heats during illumination and then cools again) that occur faster than air can mask.

Although the transducer 12 is described in conjunction with an acoustic transducer, the pyroelectric voltage source 14 may be used in conjunction with any desired type of transducer. For example, it could be used to apply voltage to a resistivity transducer or to generate X-rays (without a radioactive source) for formation density measurements, or in combination with deuterium, to generate neutrons (without a radioactive source) for formation porosity measurements. Such transducers are utilized, for example, in logging processes such as wireline logging, measurement-while-drilling (MWD) and logging-while-drilling (LWD) processes. An exemplary transducer 18 includes an acoustic imaging assembly having one or more acoustic transducers.

Figure 3:
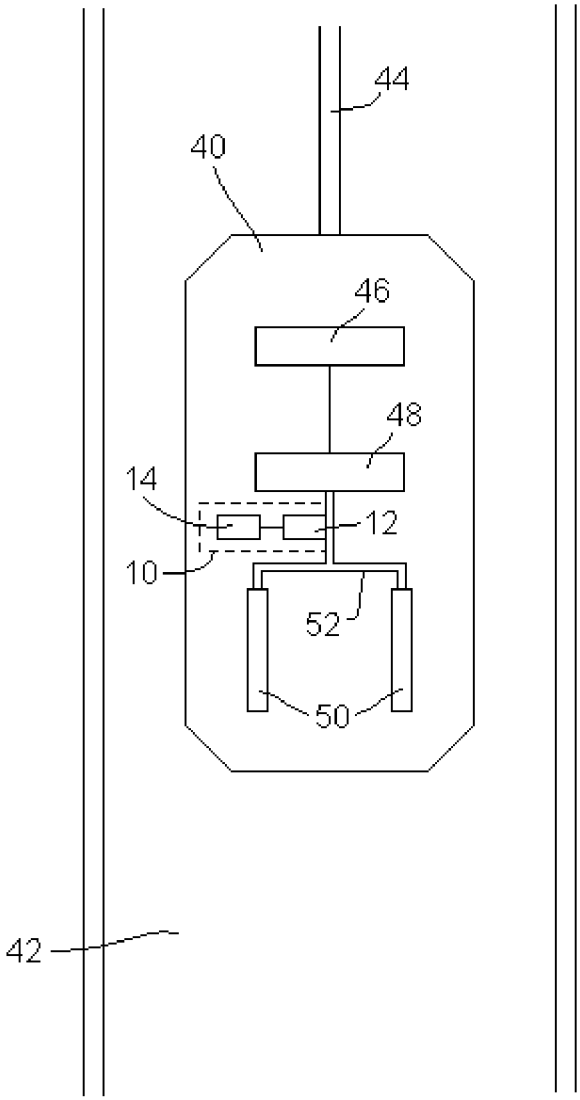
FIG. 3 depicts an exemplary embodiment of a downhole tool incorporating the transducer assembly of FIG. 1.

Referring to FIG. 3, an exemplary embodiment of a downhole tool 40 is incorporated into a well logging, production and/or drilling system. The tool 40 is shown disposed in a borehole 42 that penetrates at least one earth formation during a drilling, well logging and/or hydrocarbon production operation. The downhole tool 40 includes the transducer assembly 10 including one or more transducers 12, such as one or more acoustic transducers, and/or other components that are powered by the pyroelectric voltage source 14.

In one embodiment, the tool 40 is disposed in the borehole 42 via a wireline 44. In other embodiments, the tool 40 is disposed on or within a drillstring that includes a drill pipe, which may be one or more pipe sections or coiled tubing. The tool 40 may also be disposed as part of a bottomhole assembly (BHA). In one embodiment, the BHA includes a drilling assembly having a drill bit assembly and associated motors adapted to drill through earth formations. As used herein, "drillstring" or "string" refers to any structure suitable for lowering the tool 40 through a borehole or connecting a drill bit to the surface, and is not limited to the structure and configuration described herein. For example, the drillstring is configured as a hydrocarbon production string or formation evaluation string.

In one embodiment, the tool 40 is configured as an acoustic imaging tool. The tool 40 includes a power supply unit 46, a sample extractor 48 and one or more sample storage containers 50 to store the sample. A sample conduit 52 is connected in fluid communication between the sample extractor 48 and the storage containers 50.

Although the embodiments described herein show the acoustic transducer assembly 10 in communication with the sample conduit 52, the assembly 10 may be disposed in communication with other components, such as the sample extractor 48 or the storage containers 50. In addition, the description herein is not limited to sampling tools. The assembly 10 is, for example, be mounted on a sidewall of the tool 40 or the drillstring to take acoustic measurements of the formation and/or of borehole fluid. The assembly 10 is configured to be disposed at any location suitable to transmit acoustic signals into, and receive acoustic signals from, the borehole, the borehole fluid and/or the formation.

As described herein, "borehole" or "wellbore" refers to a single hole that makes up all or part of a drilled well. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area). Furthermore, various drilling or completion service tools may also be contained within this borehole or wellbore, in addition to formations.

In one embodiment, the transducer assembly 10 and/or the tool 40 are in communication with a surface processing unit or other unit configured to control the transducer assembly 10 and/or the tool 40, or to transmit data or signals to and from the transducer assembly 10 and/or the tool 40. The transducer assembly 10 and/or the tool 40 incorporates any of various transmission media and connections, such as wired connections, fiber optic connections, wireless connections and mud pulse telemetry.

In one embodiment, the surface processing unit, the tool 40 and/or the control unit 20 includes components as necessary to provide for storing and/or processing data collected from the tool 40 and/or the transducer assembly 10. Exemplary components include, without limitation, at least one processor, storage, memory, input devices, output devices and the like.

Figure 4:
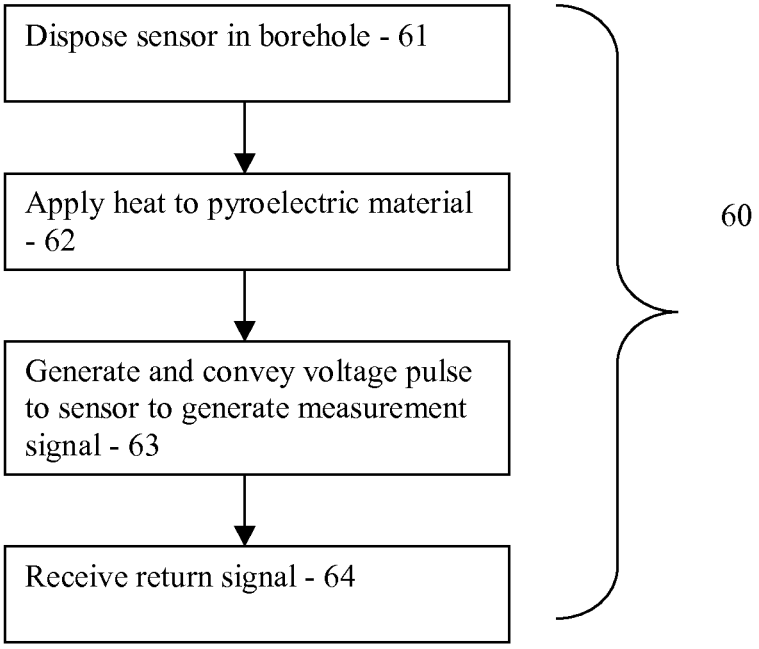
FIG. 4 is a flow chart depicting an embodiment of a method of supplying voltage to a downhole component.

FIG. 4 illustrates a method 60 of supplying voltage to a downhole component. The method 60 is used in conjunction with the transducer assembly 10 and the tool 40, although the method 60 may be utilized in conjunction with any type or number of downhole tools or downhole components requiring a voltage supply. The method 60 includes one or more stages 61, 62, 63 and 64. In one embodiment, the method 60 includes the execution of all of stages 61-64 in the order described. However, certain stages may be omitted, stages may be added, or the order of the stages changed.

In the first stage 61, a transducer or other component is disposed within the borehole 42, the transducer being operatively connected to the pyroelectric voltage source 14. In one embodiment, the transducer is disposed with a downhole tool that is lowered in the borehole 42.

In the second stage 62, heat is applied to the pyroelectric material by the heating unit 18 to cause a change in temperature sufficient to generate a desired voltage pulse. In one embodiment, the heat is applied via a source of electrical power applied to a resistive conductor connected to the pyroelectric material. In another embodiment, a laser or other source of light is directed to the pyroelectric material to heat the pyroelectric material and generate the voltage pulse. In another embodiment, the pyroelectric material is cooled, either by directly cooling the pyroelectric material (e.g., by using a heat sink) or heating the pyroelectric material and allowing it to cool, to generate the voltage pulse.

In one embodiment, the pyroelectric material is configured to be cooled to a temperature below the high downhole ambient temperatures. In another embodiment, the pyroelectric material is heated using the resistive heater or other heat source causing surface charges to change, and then the pyroelectric material is allowed to cool, causing surface charges to change again. If connected to a circuit, current will flow again, as the pyroelectric material cools back down to the ambient temperature.

In one embodiment, the temperature of a relatively thick (e.g., having a thickness on the order of millimeters) piece of pyroelectric material is ramped over seconds or minutes in a vacuum and a relay switch is used to construct a voltage pulse by momentarily or temporarily connecting the pyroelectric voltage source to the transducer and then disconnecting it. Alternatively, a thin (e.g., having a thickness on the order of microns) pyroelectric material can be heated suddenly and then allowed to cool back to ambient to produce a voltage pulse directly.

In the third stage 63, a voltage pulse is generated by the pyroelectric material and conveyed to the transducer 12 to activate the transducer 12 and emit a measurement signal into the sample, the borehole and/or the formation. In one embodiment, the transducer 12 is the acoustic transducer, and the voltage pulse fires the acoustic transducer, thereby emitting sound waves into the sample, the borehole and/or the formation.

In the fourth stage 64, the transducer 12, which may include any number of receivers, receives a return signal and generates a signal corresponding to a property of the borehole and/or the formation. In one embodiment, if the transducer 12 is an acoustic transducer, an acoustic transducer is configured as a receiver and generates an electric signal corresponding to sound waves returning from the sample, the borehole and/or the formation.

Figure 5:
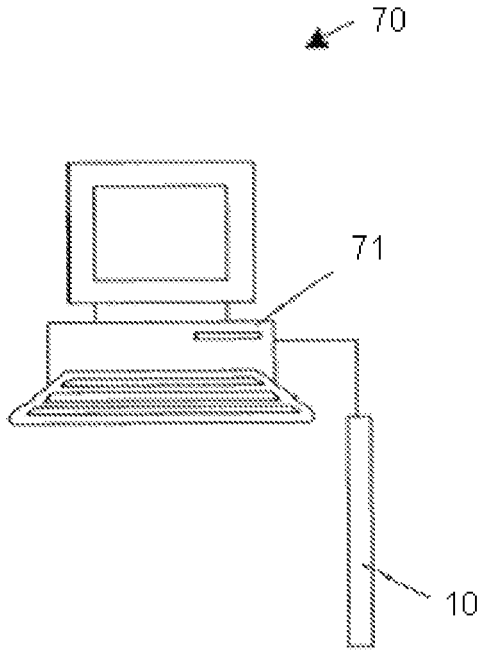
FIG. 5 is an embodiment of a system for supplying voltage to a downhole component.

Referring to FIG. 5, there is provided a system 70 for supplying voltage to a downhole component. The system may be incorporated in a computer 71 or other processing unit capable of receiving data from the tool 40 and/or the transducer assembly 10. Exemplary components of the system 70 include, without limitation, at least one processor, storage, memory, input devices, output devices and the like. As these components are known to those skilled in the art, these are not depicted in any detail herein.

Generally, some of the teachings herein are reduced to instructions that are stored on machine-readable media. The instructions are implemented by the computer 71 and provide operators with desired output.

The systems and methods described herein provide various advantages over prior art techniques. The systems and methods allow for a voltage source that is relatively low complexity and is capable of applying higher voltages with shorter cycle times than prior art voltage sources. In addition, the systems and methods described herein provide a high voltage generator that does not need to be flasked but can operate at temperatures of, for example, 300 degrees C. with little or no loss of performance.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, filtration system, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, transducer, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for supplying voltage to a downhole component, the system comprising:

a pyroelectric material disposed in electrical communication with the downhole component, the downhole component configured to be disposed within a borehole in an earth formation, the pyroelectric material selected to have a Curie temperature a predetermined amount greater than an ambient temperature in the borehole; and a heating unit in operable communication with the pyroelectric material and configured to change a temperature of the pyroelectric material and cause the pyroelectric material to generate a voltage to activate the downhole component.

2. The system of claim 1, wherein the downhole component is a transducer.

3. The system of claim 2, wherein the transducer includes at least one acoustic transducer.

4. The system of claim 1, wherein the pyroelectric material is selected from at least one of lithium niobate (LiNbO3), lithium tantalate (LiTaO3), gallium nitride (GaN), caesium nitrate (CsNO3), polyvinyl fluorides, derivatives of phenylpyrazine, cobalt phthalocyanine and triglycine sulfate (TGS).

5. The system of claim 1, wherein the heating unit includes a resistive conductor connected to a source of electrical power and connected to the pyroelectric material, the resistive conductor configured to increase in temperature in response to an electric current.

6. The system of claim 1, wherein the heating unit is an electromagnetic radiation source directed toward the pyroelectric material.

7. The system of claim 6, wherein the electromagnetic radiation source is selected from at least one of a flash lamp and a laser.

8. The system of claim 1, wherein the pyroelectric material is a thin film of pyroelectric material mounted on a substrate.

9. The system of claim 8, wherein the thin film of pyroelectric material is mounted on a plurality of protrusions extending from the substrate.

10. The system of claim 5, wherein the pyroelectric material is a thin film of pyroelectric material, and the resistive conductor includes a conductive thin film disposed in contact with the thin film of pyroelectric material.

11. A method of supplying voltage to a downhole component, the method comprising:

selecting a pyroelectric material based on the pyroelectric material having a Curie temperature a predetermined amount greater than a temperature in a borehole in an earth formation;

disposing the downhole component and the pyroelectric material in the borehole, the pyroelectric material disposed in electrical communication with the downhole component;

applying thermal energy to the pyroelectric material to cause the pyroelectric material to change temperature and emit a voltage; and conveying the voltage to the downhole component to activate the downhole component.

12. The method of claim 11, wherein the downhole component is a transducer.

13. The method of claim 11, wherein disposing the downhole component and the pyroelectric material in the borehole includes housing the downhole component and the pyroelectric material in a downhole tool and lowering the downhole tool into the borehole.

14. The method of claim 11, wherein applying thermal energy includes applying an electric current to a resistive conductor in contact with the pyroelectric material.

15. The method of claim 11, wherein applying thermal energy includes directing electromagnetic radiation toward the pyroelectric material.

16. The method of claim 12, wherein activating the transducer includes causing the sensor to emit a measurement signal into at least one of the borehole and the formation.

17. The method of claim 16, further comprising receiving a return signal from the at least one of the borehole and the formation and generating a signal corresponding to a property of the at least one of the borehole and the formation.

18. The method of claim 16, wherein the transducer is an acoustic transducer and the measurement signal is an acoustic signal.

19. The method of claim 11, wherein the pyroelectric material is selected from at least one of lithium niobate (LiNbO3), lithium tantalate (LiTaO3), gallium nitride (GaN), caesium nitrate (CsNO3), polyvinyl fluorides, derivatives of phenylpyrazine, cobalt phthalocyanine and triglycine sulfate (TGS).

20. The system of claim 1, wherein the pyroelectric material is a thin film of pyroelectric material, the heating unit includes a resistive conductor including a conductive thin film disposed in contact with the thin film of pyroelectric material, and the resistive conductor is mounted on a plurality of protrusions extending from a substrate.

* * * * *